United States Patent [19]

Wagner

[11] Patent Number: 4,643,232

[45] Date of Patent: Feb. 17, 1987

[54] HARNESS FRAME FOR A WEAVING LOOM

[76] Inventor: Theodor E. Wagner, 101 Mabry Dr., Spartanburg, S.C. 29302

[21] Appl. No.: 808,649

[22] Filed: Dec. 13, 1985

[51] Int. Cl.[4] ..... D03C 9/06

[52] U.S. Cl. ..... 139/92

[58] Field of Search ..... 139/91, 92

[56] References Cited

U.S. PATENT DOCUMENTS

| | | | |
|---|---|---|---|
| 3,895,655 | 7/1975 | Sujdak et al. | 139/92 |
| 4,112,980 | 9/1978 | Badar | 139/92 |
| 4,252,153 | 2/1981 | Kaufmann et al. | 139/92 |
| 4,404,994 | 9/1983 | Root et al. | 139/91 |
| 4,506,707 | 3/1985 | Simizu | 139/91 |

FOREIGN PATENT DOCUMENTS

| | | | |
|---|---|---|---|
| 344384 | 3/1960 | Switzerland | 139/92 |
| 788171 | 12/1957 | United Kingdom | 139/92 |

*Primary Examiner*—Henry S. Jaudon

*Attorney, Agent, or Firm*—Luke J. Wilburn, Jr.

[57] ABSTRACT

An improved harness frame for a weaving loom for adjustably supporting a plurality of heddles in planar array therein, upper and lower spaced horizontal frame members of the harness frame having elongate, slotted guide channels for slidably receiving channel-insert portions of a heddle assembly, centerstays, and associated frame hardware for positional adjustment therealong, and fluid-actuated, expandable tubes located in the frame members and disposed for communication with the guide channels to exert a pressure force against the channel-insert portions of the centerstays, heddle assembly, and frame hardware to fix the positions of the same at desired locations along the frame members.

11 Claims, 5 Drawing Figures

HARNESS FRAME FOR A WEAVING LOOM

The present invention is directed to an improved harness frame for a weaving loom, and more particularly, to a harness frame having improved means for adjustably securing supporting centerstays, heddle assemblies, and other attachments to the harness frame for use in warp shed-forming operations.

BACKGROUND OF THE INVENTION

In the manufacture of woven fabrics on an automatic weaving loom, a plurality of warp yarns or other strand material from a warp beam are threaded through a plurality of harness frames containing heddle assemblies which are vertically reciprocated to form the warp shed. Fill yarns are inserted into the shed by suitable insertion means, such as shuttles, to form the fabric. By varying the movements of the harness frames in accordance with pattern control means, fabrics of various woven construction are produced.

A harness frame of a weaving loom is of generally rectangular shape and has upper and lower vertically spaced, horizontal support members interconnected at their ends by vertical support members. Supported within the frame is a heddle assembly, comprising a planar array of heddles, or wires, containing eyelets through which individual warp yarn ends are threaded. The heddles are supported at their upper and lower ends on elongate heddle support rails, or bars, which extend closely adjacent and parallel to the upper and lower horizontal frame support members and are attached thereto by suitable means, such as heddle bar support plates. To provide stability to the harness frame and heddle assembly, the upper and lower support members of the harness frame are interconnected intermediate their ends and across the planar heddle array by one or more rigid centerstays.

For a particular pattern weave and width of fabric to be produced, the harness centerstays and heddle assembly are adjustably positioned and secured to the harness frame. The heddle bars and their attaching support plates also may be removed and repositioned in the harness frame for replacement of individual heddles of the heddle assembly.

In the past, positional adjustment of the centerstays and heddle assembly of a harness frame has been accomplished by manually positioning the centerstays and heddle bars with their support plates along channels or guideways in the upper and lower frame support members, with securement of the ends of each centerstay and each heddle bar plate to the frame members by mechanical locking devices, such as bolts or screws. Such adjustment requires that a loom operator individually position and mechanically secure the ends of each centerstay and each heddle bar support plate to the upper and lower frame members across the full width of the harness frame. Adjustable positioning and individual securement of the ends of each centerstay and each heddle bar support plate obviously is time-consuming in the weaving and preparing operation. Further, it is particularly difficult to reach the area of the lower horizontal support members of the frames when the harness assembly is threaded with the warp yarns. One such form of harness frame requiring securement of the individual supporting elements of the centerstays and heddle bars to the frame members is disclosed in my prior U.S. Pat. No. 3,221,776.

BRIEF OBJECTS OF THE PRESENT INVENTION

It is therefore an object of the present invention to provide a harness frame for a weaving loom having improved means for adjustably positioning and securing the supporting centerstays, heddle assemblies, and other attachments to the harness frame.

It is another object to provide an improved harness frame for a weaving loom wherein the supporting centerstays, heddle assembly supports, and associated attachments of the harness frame may be adjustably located and securely fixed in position in the channel guideways therein in a more efficient and less time-consuming manner than harness frames of the prior art requiring individual manual securement of the same by the loom operator.

BRIEF SUMMARY OF THE INVENTION

The present invention comprises a harness frame for a weaving loom for supporting a heddle assembly and supporting centerstays. The securing elements, or portions, of the heddle assembly and centerstays are mounted for sliding movement in support channels of the upper and lower support members of the frame for positional adjustment, and fluid-actuated pressure-applying means are employed to secure and fix the position of the securing elements of the centerstays and heddle assembly at desired locations in the harness frame.

More specifically, the securing elements of the supporting centerstays heddle assembly, and other frame attachments are slidably received within respective elongate slotted channels of the upper and lower frame support members, and are engaged by a pneumatically actuated, flexible tubes communicating with the elements and channels. The tubes may be actuated with air to simultaneously fix some or all of the elements at desired positions along the frame members.

BRIEF DESCRIPTION OF THE DRAWINGS

The above, as well as other objects of the invention, will become more apparent, and the invention will be better understood, from a detailed description of preferred embodiments thereof, when taken together with the accompanying drawings, in which.

DETAILED DESCRIPTION OF PREFERRED EMBODIMENTS

Figure 1:
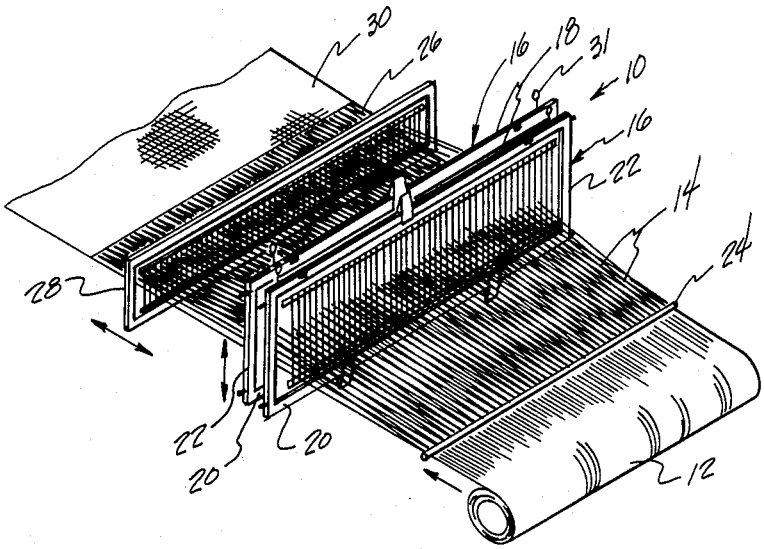
FIG. 1 is a schematic perspective view of the harness portion of a weaving loom employing improved harness frames of the present invention.

Referring now more specifically to the drawings, FIG. 1 shows in schematic perspective view the harness portion 10 of one type of automatic weaving loom. As illustrated, the loom comprises one or more warp beams 12 which carry a supply of warp threads, or strands, 14, which pass in usual manner through respective eye portions of the heddles of a plurality of vertically displacable harnesses 16. Each harness 16 comprises a generally rectangular frame having parallel upper and lower horizontal frame members 18, 20 interconnected at their ends by vertical frame members, or endstays, 22. One or more conventional lease rods 24 are provided to guide the warp threads 14 from the warp beams into the harnesses. Weft threads (not shown) are laid into a warp shed portion 26 formed by vertical displacement of one or more of the harnesses (only two of which are illustrated), while a reed 28 is reciprocated, in the directions of the arrow, to beat up the weft threads inserted into the warp shed and form a woven fabric 30 which is taken up on another beam (not shown) in conventional manner. The harnesses 16 are lifted and lowered by lifting hooks 31 connected in suitable manner, such as by cords, to conventional pattern-control mechanisms (not shown) to produce the desired woven pattern in the fabric formed on the loom.

Figure 2:
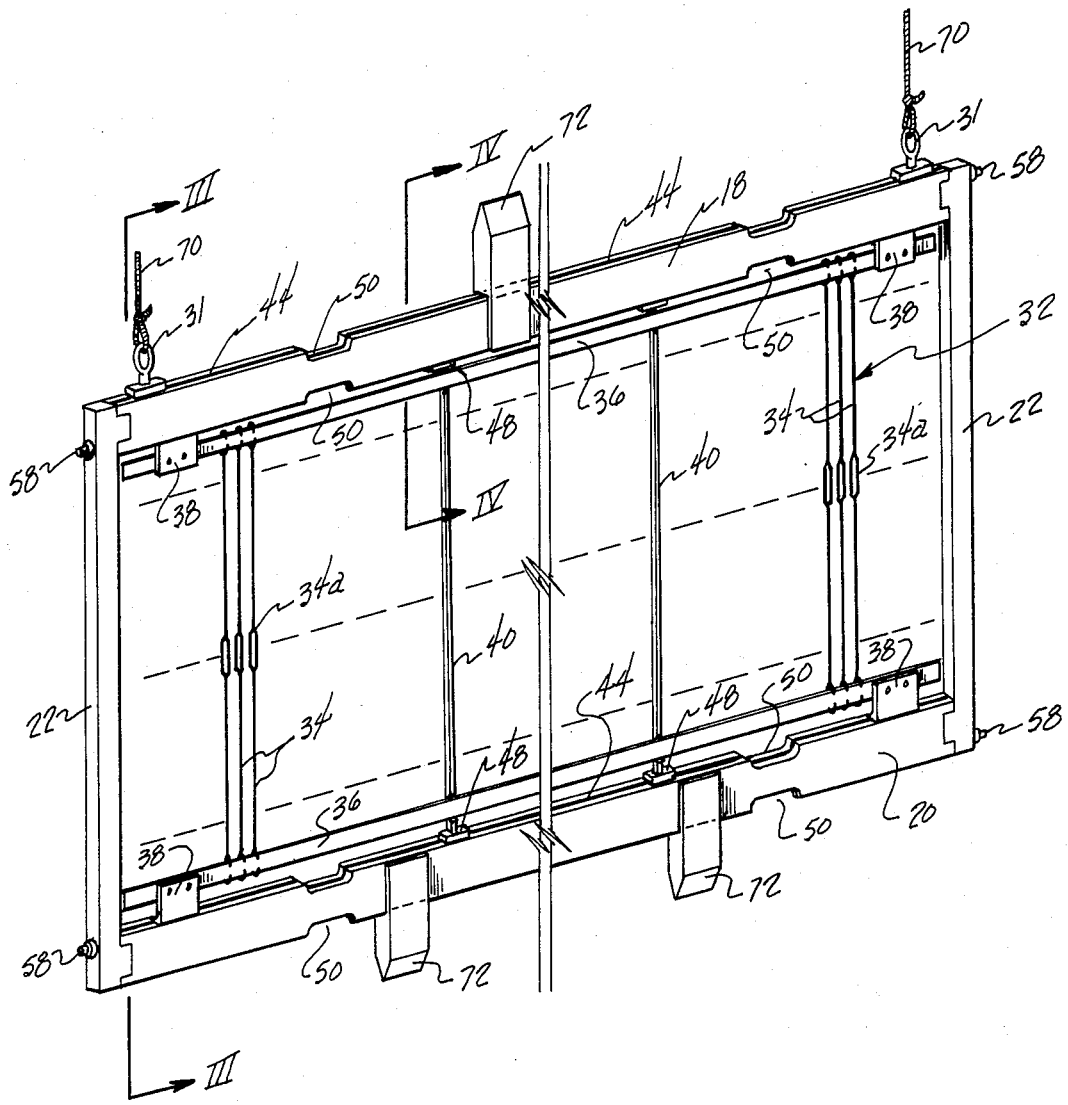
FIG. 2 is an enlarged, schematic perspective view of one of the harness frames of FIG. 1, with its associated centerstays and heddle assembly, and illustrating the arrangement and connection of supporting centerstays, a heddle assembly, and related hardware to the harness frame.

As best seen in FIG. 2, supported in each harness frame is a heddle assembly 32 comprising a plurality of individual heddles, or wires, 34 (only certain of the heddles in the heddle assembly are shown in FIG. 2), having thread-receiving eyelets 34*a* therein. The heddles are supported at their upper and lower ends on heddle support rails, or bars, 36, which are connected to the respective upper and lower horizontal support members 18, 20 of the harness frame by suitable connecting means, such as heddle bar support plates 38 spaced along the bars 36. Each harness also includes one or more vertical supporting centerstays, 40, located intermediate the sides of the harness frame and connected to the upper and lower frame members 18, 20 to support and stabilize the frame during the weaving operation.

Figure 3:
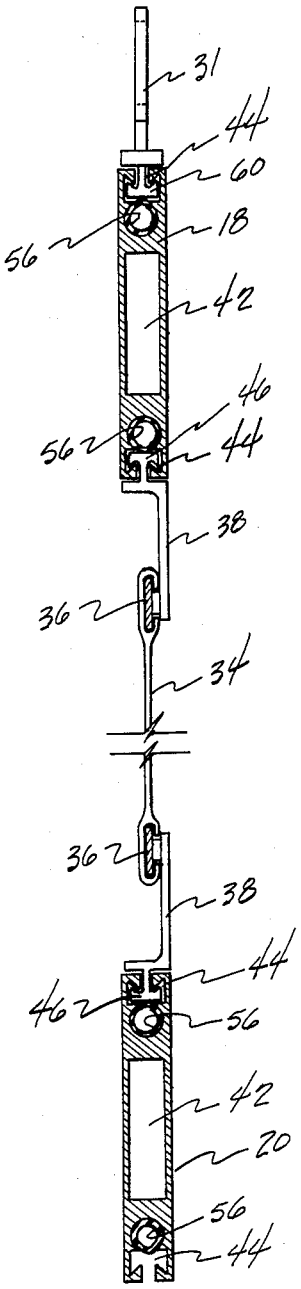
FIG. 3 is a cross-sectional view of the upper and lower horizontal support members of the harness frame, taken along line III—III of the harness frame of FIG. 2.

Referring to FIG. 3, the upper and lower spaced, horizontal support members 18, 20 of each harness frame are constructed of suitable high-strength, lightweight material, such as an extruded aluminum bar, having a central cavity 42. The exterior and the interior edge portions of each horizontal frame member 18, 20 has an elongate slotted guide channel 44 extending therealong, with the interior edge guide channels of the upper and lower members 18, 20 disposed in facing relation to each other. The heddles 34 form a planar array in the harness frame and are mounted at their upper and lower ends on the respective heddle support bars 36. Each heddle bar support plate 38 is fixed, as by rivets, to its support bar and includes a channel-insert portion 46 shaped to be closely received within the interior edge portion guide channels 44 of the respective upper and lower frame members for sliding, adjustable movement therealong.

Figure 4:
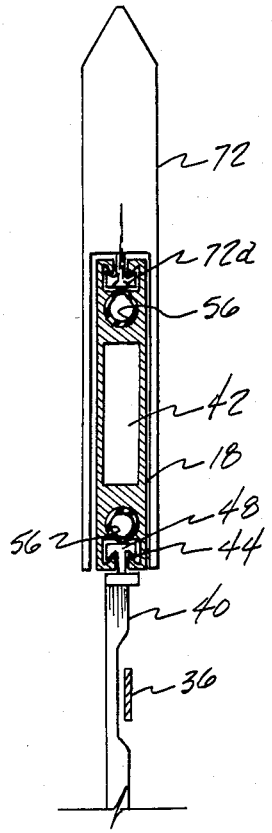
FIG. 4 is an enlarged cross-sectional view of the upper horizontal support member of the harness frame, taken along line IV—IV of FIG. 2.

As shown in FIGS. 2 and 4, vertical supporting centerstays 40 of the harness frame each comprises an elongate rigid rod having attached to each end a short transverse element forming a channel-insert portion 48 closely received within the interior edge guide channels 44 of the respective upper and lower frame members for adjustable sliding movement therealong. As seen in FIG. 2, one or more openings, or slots, 50 are provided in side walls of the upper and lower frame members 18, 20 which communicate with the guide channels 44 to permit ready insertion of the channel-insert portions 48 of the struts into the channels. The insert portions 46 (FIG. 3) of the heddle bar support plates 38 are slidably received within the interior edge channels 44 of the upper and lower frame members 18, 20 by removal of a vertical frame endstay 22 at one end of the harness frame. Depending upon the woven fabric construction and fabric width to be produced on the automatic weaving loom, the heddle assembly and supporting centerstays are adjustably positioned to desired locations in the harness frame by the loom operator.

Figure 5:
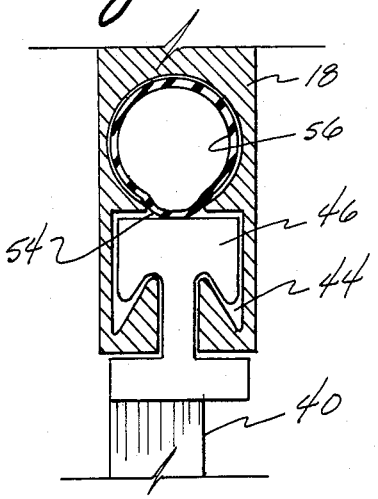
FIG. 5 is a further enlarged cross-sectional view of the lower edge portion of the upper support member of FIG. 4, showing in greater detail the engagement of a pneumatic pressure-applying tube of the frame with the channel-insert portion of one of the centerstays of the frame.

As best shown in FIGS. 3–5, each of the upper and lower support members 18, 20 of the harness frame is provided with an elongate tubular passageway which extends the length of each slotted guide channel 44 of the member and communicates therewith by way of a continuous slot, or opening, 54 (FIG. 5) therebetween. Mounted in the tubular passageways of each support member is a flexible, expandable tube 56 formed of suitable elastomeric material, such as rubber or the like. The interior of each tube 56 is connected by a conduit 58 (FIG. 2) and control valve means (not shown) to a suitable source of compressed fluid, such as an air compressor (not shown). When compressed air is introduced into the flexible tubes 56, the tubes expand so that the portions of the same adjacent the communicating openings 54 engage and apply pressure to the adjacent surfaces of each of the channel-insert portions 46, 48 of the supporting centerstays and heddle bar support plates in frame member channels 44 to positionally fix the channel-insert portions, and thus the centerstays and heddle assembly, in the harness frame.

As also seen in FIGS. 2–4, the channels 44 in the exterior edge portions of frame members 18, 20 slidably receive additional hardware to be attached to the harness frame. As seen, mounted for adjustable sliding movement in the exterior edge channel 44 of the frame member 18 are one or more lifting hooks 31 which have channel-insert portions 60 received for sliding movement in the channel. The lifting hooks 31 are attached by continuous elements, such as wires or cords 70, to a pattern-control mechanism of the automatic weaving loom which raises and lowers the harnesses in a manner well known in the art to form the warp shed.

Also attached to the upper and lower members 18, 20 of the harness frame are guide nose pieces 72 (FIGS. 2 & 4) which serve to space the harness frames in the harness portion of the loom from each other and guide the frames during their vertical reciprocating movement. Each guide nose piece 72 (FIG. 4) is secured to upper or lower respective frame members of each harness frame by channel-insert portions 72*a* (FIG. 4) thereof which are slidably received within the channels on the exterior edge portions of the members. The flexible, inflatable tubes 56 communicating with the channels 44 thus are correspondingly inflated with fluid pressure, such as air, from an air compressor, when it is desired to fix the position of the lifting hooks 31 and guide nose pieces 72 after they have been adjustably positioned on the harness frame by the loom operator.

When it is desired to remove or reposition the centerstays, heddle bars, or other hardware of the harness frames, air pressure is released from the tubes by suitable venting means, such as a control valve, to release their channel-insert portions and permit their movement along the channels.

As can be understood from the foregoing explanation, the channel-insert portions of the centerstays, heddle bar support plates, and associated attachable hardware of the frame may be simultaneous and selectively positively gripped and released in the channels of the frame members by the tubes 56 to fix or release the positions of the struts, heddles, and hardware in the frame.

That which is claimed is:

1. An improved harness for a weaving loom comprising a support frame having upper and lower spaced frame members for adjustably positionally supporting a plurality of heddles in planar array therebetween, each of said upper and lower frame members having an elongate, slotted guide channel extending along its interior edge with the channels of the members disposed in facing relation to each other, at least one rigid supporting centerstay extending between the upper and lower support frame members and having a channel-insert portion at its upper and lower end disposed within the respective slotted guide channel of the frame members for adjustable sliding movement therealong to position the supporting centerstay at a desired location along the frame members, and fluid-actuated, pressure-applying means communicating with the elongate guide channels for applying pressure to the channel-insert portions of the centerstay in the guide channels to fix the position of the centerstay at a desired location along the frame members.

2. An improved harness as defined in claim 1 wherein said fluid-actuated pressure-applying means comprises flexible tubular means communicating with the slotted guide channel of each frame member to expand thereinto and apply pressure to the channel-insert portions of the centerstays disposed therein to secure and fix them in a desired position against movement in the channels.

3. An improved harness as defined in claim 1 including upper and lower elongate heddle support bars for supportably receiving a plurality of heddles thereon, connecting means on the bars having a channel-insert portions disposed within the elongate slotted guide channels of respective of the frame members for receiving pressure from said pressure-applying means to fix the position of the insert portions at desired locations along the channels.

4. An improved harness as defined in claim 3 wherein said fluid-actuated, pressure-applying means comprises flexible tubular means communicating with the slotted guide channel of each frame member to expand thereinto and apply pressure to the channel-insert portions of the centerstays and heddle bar connecting means disposed therein to secure and fix them in desired positions against movement in the channels.

5. An improved harness as defined in claim 3 wherein the pressure-applying means comprises an inflatible, flexible tube extending along the length of the frame members in communication with the slotted guide channels, and means for connecting the interior of the tube to a source of fluid pressure to expand the tube into pressure-engagement with the channel-insert portions of the supporting centerstays and the heddle bar connecting means disposed therein.

6. An improved harness as defined in claim 1 wherein the exterior edge portions of the horizontal support members of the harness frame have a slotted channel extending therealong, a plurality of frame attachment members having channel-insert portions receivable in the slotted channels for adjustable positioning therealong, and fluid-actuated pressure-applying means communicating with the channels for engaging and fixing the channel-insert portions of the attachment members at desired locations along the channels of the support frame members.

7. An improved harness frame for a textile weaving loom having upper and lower spaced frame members for adjustably positionally supporting support struts and a heddle assembly therebetween, said upper and lower frame members having elongate, slotted guide channels disposed in facing relation to supportably receive therein channel-insert portions of supporting centerstays and a heddle assembly when placed in the guide channels to extend between the upper and lower frame members, and fluid-actuated, pressure-applying means communicating with the elongate guide channels for applying pressure to channel-insert portions of centerstays and a heddle assembly when placed in the guide channels to fix the position of the centerstays and heddle assembly at desired locations in the frame.

8. An improved harness for a weaving loom comprising a generally rectangular support frame for adjustably positionally supporting a plurality of heddles in planar array therein, said frame including upper and lower spaced frame members each having an elongate slotted guide channel extending therealong with the guide channels of the upper and lower members disposed in facing relation, means for supportably attaching a planar array of heddles to the support frame including channel-insert portions receivable in respective slotted guide channels of the frame members for adjustable sliding movement therealong to position the heddle array at a desired location in the frame member, and fluid-actuated, pressure-applying means communicating with the elongate guide channels for applying pressure to the channel-insert portions of the heddle array attaching means to fix the position of the insert portions at desired locations in the frame.

9. An improved harness as defined in claim 8, including at least one rigid supporting centerstay extending between the upper and lower support frame members and having a channel-insert portions at its upper and lower end disposed within the respective slotted guide channels of the frame members for adjustable sliding movement therealong and for engagement by said fluid-actuated pressure-applying means to fix the position of the centerstay at a desired location in the frame.

10. An improved harness as defined in claim 9 wherein said fluid-actuated, pressure-applying means comprises a flexible tube communicating with the slotted guide channel of each frame member to expand therein and apply pressure upon the channel-insert portions of the centerstays and heddle array attaching means to secure and fix them in a desired position against movement in the channels.

11. An improved harness frame for a weaving loom having upper and lower frame support members with elongate, slotted guide channels therein for receipt of channel-insert portions of harness components for attachment thereto and for slidable adjustable movement therealong to position the components in desired locations in the frame, and fluid-actuated, pressure-applying means in said upper and lower members communicating with said channels for exerting a pressure against the channel-insert portions to fix the positions of the components in the harness frame.

* * * * *